United States Patent [19]

Trevino, Jr.

[11] 4,372,402

[45] Feb. 8, 1983

[54] COMBINATION FLUID NOZZLE AND BACKFLOW VALVE

[75] Inventor: Joe Trevino, Jr., Houston, Tex.

[73] Assignee: Reed Rock Bit Company, Houston, Tex.

[21] Appl. No.: 313,527

[22] Filed: Oct. 21, 1981

[51] Int. Cl.[3] ..... E21B 10/18

[52] U.S. Cl. ..... 175/318; 175/340

[58] Field of Search ..... 175/340, 339, 393, 422; 166/325; 239/590, 596

[56] References Cited

U.S. PATENT DOCUMENTS 3,261,413 7/1966 Kistler, Jr. ..... 175/422

3,685,601 8/1972 Hollingshead ..... 175/318

FOREIGN PATENT DOCUMENTS 1027469 12/1964 United Kingdom ..... 175/340

*Primary Examiner*—Stephen J. Novosad

*Assistant Examiner*—Joseph Falk

*Attorney, Agent, or Firm*—Michael J. Caddell

[57] ABSTRACT

A valve-nozzle assembly is disclosed for use in a rock-drilling bit, which assembly utilizes a backflow valve with a replaceable nozzle insert.

5 Claims, 6 Drawing Figures

27

COMBINATION FLUID NOZZLE AND BACKFLOW VALVE

BACKGROUND OF THE INVENTION

The present invention generally involves nozzle assemblies for rock-drilling bits and more particularly discloses a nozzle assembly having a backflow valve combined with a replaceable nozzle insert. Presently, conventional rock bit structures utilize fluid ejection nozzles which are set into the main body of the drilling bit and communicate with fluid passages inside the bit. Generally, these nozzle assemblies are placed in tandem with backflow valves above the nozzle openings. Present structures utilize nozzles which are integrally formed in the bodies of the nozzles and have a single size opening therethrough. Replacement of the nozzles to change diameter of the openings or to replace eroded nozzles requires replacement of the entire nozzle body. Likewise, the replacement of the backflow valves which may be located above the nozzle bodies inside the nozzle cavity usually requires removal of the nozzle body.

As an example, the Nickles patent U.S. Pat. No. 3,198,269 illustrates the drill bit having a centrally-located backflow prevention valve placed between the lugs of a rolling-cutter drill bit. Removal of this valve assembly requires disassembly of the rock bit from the drill string and removal up through the central bore of the bit or removal of the rolling cutters to remove the valve through the bottom of the bit. Likewise the Talbert patent U.S. Pat. No. 3,401,758 discloses a rock drilling bit having a centrally located flow control valve which must be removed upward through the bit. The Talbert patent also discloses separate jet nozzles in the bottom portion of the bit body, independent from the flow control valve.

The patent to Hollingshead U.S. Pat. No. 3,685,601, discloses a rock bit having a combination check-flow valve and nozzle located in the lower portion of the bit body. Replacement of eroded nozzles requires removal and replacement of the entire nozzle and check-flow valve assembly.

In copending applications Ser. No. 293,053 and 293,054, by William S. Price and Howard E. Mitchell for "FLUID PRESSURE REGULATOR FOR DRILL BIT" and "AIR PRESSURE REGULATOR FOR DRILL BIT", which copending applications are assigned to the same assignee as the present application, drill bits are disclosed which utilize nozzles requiring removal and replacement of the entire nozzle when erosion of the nozzle orifice requires replacement thereof. These two copending applications are herein incorporated by reference in their entirety. Thus, conventional nozzle construction in existing rock drilling bits requires removal of the nozzle bodies for replacement of the entire nozzles upon erosion of the nozzle orifice. The present invention overcomes these difficulties by providing a combined nozzle and backflow valve assembly which allows easy replacement of the nozzle orifice without removal of the entire assembly and without replacing the entire body.

DESCRIPTION OF THE PREFERRED EMBODIMENTS

Figure 1:
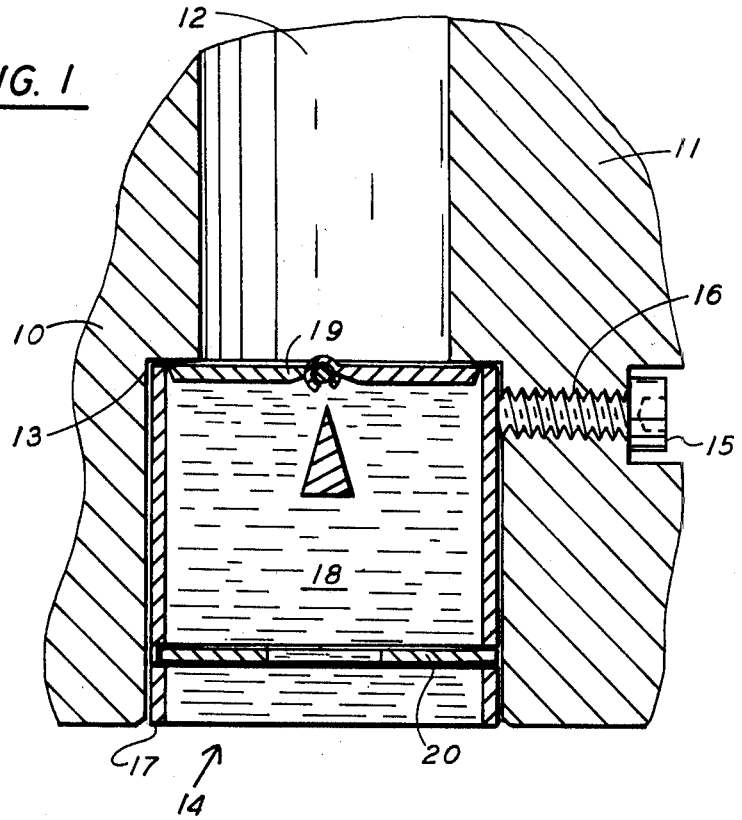
FIG. 1 is a side cross-sectional view of the nozzle assembly of this invention.
Figure 3:
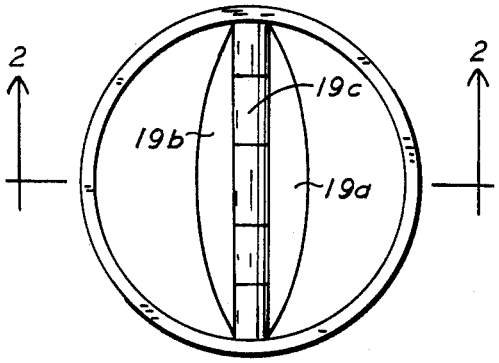
FIG. 3 is a top view of the nozzle assembly.

FIG. 1 is a partial cross-sectional view of the body portion of a rolling cutter drill bit illustrating the nozzle area 10 of the bit. The nozzle area generally comprises the bit body 11, a fluid flow passage 12, and a nozzle bore passage 13. A flow control valve and nozzle assembly 14 is securely held in cavity 13 by means of a threaded set screw 15 passing through threaded section 16 of lug 11 and abutting the nozzle assembly 14 in wedging relationship. Nozzle assembly 14 generally comprises a hollow body section 17 having an open interior area 18, a valve backflow assembly 19, and a nozzle orifice plate 20.

Figure 2:
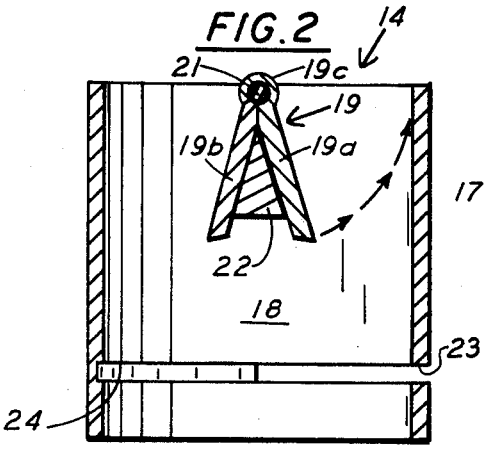
FIG. 2 is a side cross-sectional view of the nozzle body.

Referring now to FIGS. 2 through 6, the nozzle assembly 14 is shown in more detail. In FIG. 2, the nozzle body 17 has a flow passage 18 through the interior thereof and a flapper valve assembly 19, located therein. Valve assembly 19 comprises a pair of semi-circular flappers **19*a* and 19*b* having the cylindrical hinge pin section 19*c* formed at the end thereof located rotatably on a lateral hinge pin 21 firmly secured in body 17 and passing across a diameter thereof. Hinge section 19*c* works much the same way as a common door hinge works. A stop 22, formed in a general wedge shape, is also secured in a diametral position within body 17 to prevent total closing of flappers 19*a* and 19*b* and to allow upward fluid pressure to act on these elements to close them against upward fluid flow. Alternatively to a stop member 22, a spring coiled around pin 21 and abutting flaps 19*a* and 19*b*** could be used to bias the flaps upward into a closed position.

A semicircular circumferential radial slot 23 is cut through approximately one-half of nozzle body 17. A radial groove 24 is formed in the interior wall of body 18 coplanar with slot 23 and aligned therewith. The groove 24 extends approximately one-fourth to one-half the thickness of wall 17 into the wall. Slot 23 is cut entirely through the wall of body 17 and is at least one-half of the circumference of the cylindrical body 17.

Figure 5:
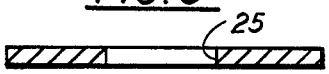
FIGS. 4 through 6 are illustrations of the nozzle orifice plate.
Figure 4:
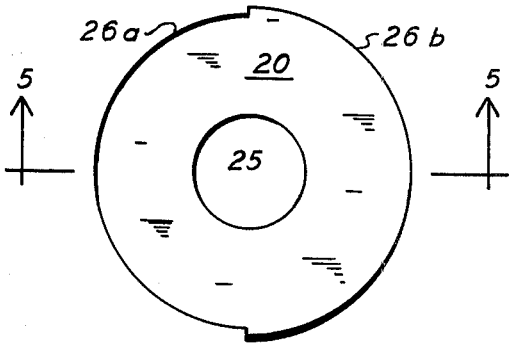
Figure 6:
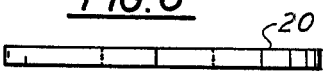

FIG. 4 illustrates a top view of the orifice plate 20, designed to slide into slot 23 and engage groove 24. Plate 20 has a generally centrally located nozzle opening 25 formed therethrough and a double-diameter outer circumference. The left-hand portion **26*a* of orifice plate 20 has a smaller diameter than the right-hand portion 26*b* of the plate. The diameter of section 26*a* is selected such that plate 20 will fit snugly and sealingly within groove 24 of body 17. Likewise, the diameter 26*b* of plate 20 is selected such that the plate will extend approximately to the outer edge of body 17 when plate 20 is inserted completely within groove 23 and slot 24. FIG. 5 is a cross-sectional sideview of plate 20 illustrating orifice opening 25. FIG. 6 is a full side view of the orifice plate 20 illustrating by reference arrow 27, how orifice plate 20 is inserted into nozzle body 17. The coaction of edge 26*a* in groove 24 and edge 26*b* in slot 23 provides a secure locking mechanism for nozzle plate 20 within nozzle body 17**.

The nozzle assembly in the present invention is assembled into a drilling bit thusly. The nozzle body 17 is provided with a diametral hinge pin 21 and the flapper valves 19*a*, and 19*b* are rotatably secured on the pin prior to its location inside body 17. An opening wedge 22 may be located under pin 21 to maintain the flapper valve in a partially open position. Alternately, a coil spring may be used to bias the flappers into their upward closed location. A nozzle plate 20 is selected having a desirable orifice opening 25 for the desired flow characteristics of the bit and arranged to fit snugly within nozzle body 17. The orifice plate is slipped into the groove and slot (24, 23) formed in body 17 as illustrated at FIGS. 2 and 6 by numeral 27. The nozzle assembly is then placed into the nozzle recess 13 formed in the body of the bit 10. A threaded lock screw 15 is threadedly engaged in the threaded opening 16 and and tightened until it abuts nozzle body 17 thereby tightly wedging the nozzle assembly in the nozzle recess. The nozzle body diameter is chosen to snugly fit within recess 13 and extend outwardly a measurable distance past flow passage 12 in the bit body. Thus when flappers 19 are moved upward in response to attempted backflow by fluid from below the bit, the flappers will sealingly abut the radial outward edges of passage 12 and thereby prevent flow of fluid thereby. Upon the application of pressurized fluid through bore 12, the pressure differential across flappers 19 will move them downward and allow fluid to flow through the measured orifice opening 25 in orifice plate 20.

When the orifice plate 20 has eroded or failed or in the instances where the flow characteristics of pressurized fluid supplied to the bit have changed, and it is required to change the orifice opening in the nozzle assembly, this may be done easily and quickly by releasing threaded screw 15, sliding nozzle body 17 out of cavity 13 a short distance to expose slots 24 in groove 23, removal of plate 20, and installation of a new plate 20 with the same or different size orifice 25 and then reinstallation of the nozzle body as previously described.

Thus, it can be seen that the present invention discloses a nozzle assembly having a removable orifice plate which can be replaced when it is desirable to change orifice openings or to replace eroded orifice plates. Replacement of the nozzle opening does not require replacement of the entire valve assembly.

Although a specific preferred embodiment of the present invention has been described in the detailed description above, the description is not intended to limit the invention to the particular forms or embodiments disclosed therein, since they are to be recognized as illustrative rather than restrictive, and it would be obvious to those skilled in the art that the invention is not so limited. Thus, the invention is declared to cover all changes and modifications of the specific example of the invention herein disclosed for purposes of illustration which do not constitute departure from the spirit and scope of the invention.

The embodiments of the invention in which an exclusive property or privilege is claimed or defined are as follows:

1. A nozzle valve assembly for use in a nozzle recess in a rock drilling bit having internal, pressurized-fluid supply passages, said nozzle assembly comprising;

(a) a generally cylindrical hollow nozzle body adapted for relatively close fitting engagement in the nozzle recess of a rock drilling bit and having open axial ends;

(b) a backflow valve assembly mounted adjacent one end of said nozzle body to allow fluid to flow in only one direction through said nozzle body; and (c) a semicircular radial slot formed through the sidewall of said cylindrical nozzle body; and (d) an orifice plate having a nozzle opening formed centrally therethrough, said plate being configured for insertion through said slot for secure retention within said body so that all of the fluid flowing through said body passes through said nozzle opening.

2. The nozzle assembly of claim 1 wherein said backflow valve assembly comprises a flapper valve hingeably secured in said nozzle body.

3. The valve assembly of claim 1 or claim 2 wherein said nozzle body has an internal radial groove formed in the internal sidewall thereof and said semicircular slot is formed coplanar with said groove and extends at least one-half the circumference of said nozzle body.

4. The nozzle assembly of claim 1 or claim 2 wherein said nozzle body has a semicircular radial groove formed in the internal sidewall thereof and aligned with said semicircular radial slot, formed in the internal sidewall thereof and said orifice plate comprises a relatively flat disc having a first semicircular diameter arranged for relatively snug-fitting engagement in said semicircular radial slot in said nozzle body.

5. In a jet-type rock drilling bit having internal bore passages for supplying fluid pressure to openings on the bit body, the improvement comprising:

a nozzle backflow valve assembly for replacement in said bit and arranged for emitting pressurized fluids communicated therewith from said bit fluid passages and further arranged to prevent backflow of well fluids into said bit;

wherein said assembly comprises a generally cylindrical hollow nozzle body having open ends;

a hingeably secured backflow valve assembly located in said nozzle body;

a semicircular radial groove formed in said body and coplanar and coincident with a semicircular radial slot formed through the wall of said body; and a nozzle orifice plate having a nozzle orifice opening of preselected diameter formed therethrough with a first semicircular diameter arranged for snug engagement in said semicircular radial groove in siad body and a second semicircular diameter arranged for snug fitting engagement in said semicircular radial slot in said body.

* * * * *